United States Patent [19]

Gilreath

[11] 4,040,133

[45] Aug. 9, 1977

[54] BEDDING ATTACHMENT SYSTEM

[76] Inventor: Murvin Bruce Gilreath, 4047 Mistral Drive, Huntington Beach, Calif. 92649

[21] Appl. No.: 700,287

[22] Filed: June 28, 1976

[51] Int. Cl.[2] ..... A47G 9/04

[52] U.S. Cl. ..... 5/320; 5/335

[58] Field of Search ..... 5/334 R, 335, 320, 322, 5/334 C, 319

[56] References Cited

U.S. PATENT DOCUMENTS

| | | | |
|---|---|---|---|
| 2,024,056 | 12/1935 | May | 5/320 |
| 3,011,182 | 12/1961 | Burks | 5/334 R |
| 3,092,848 | 6/1963 | Gronvold | 5/320 |
| 3,858,256 | 1/1975 | Beer | 5/335 |
| 3,965,504 | 6/1976 | Ainsworth | 5/335 |

*Primary Examiner*—Paul R. Gilliam

*Assistant Examiner*—Alex Grosz

*Attorney, Agent, or Firm*—Knobbe, Martens, Olson, Hubbard & Bear

[57] ABSTRACT

A section of Velcro material is positioned on the edge of waterbed mattress adjacent each corner. The material is either connected directly to the mattress or attached to a strip of material that extends beneath the mattress and is secured there by the weight of the mattress. The Velcro material is attached to mating Velcro material formed on a mattress pad and/or a lower sheet. An upper sheet is similarly provided with Velcro material to engage or mate with such material on the lower sheet. The section of Velcro may be secured to the mattress by a section of elastic material which will facilitate holding the bedding to the mattress but yet accommodate relative movement of the mattress and bedding.

3 Claims, 10 Drawing Figures

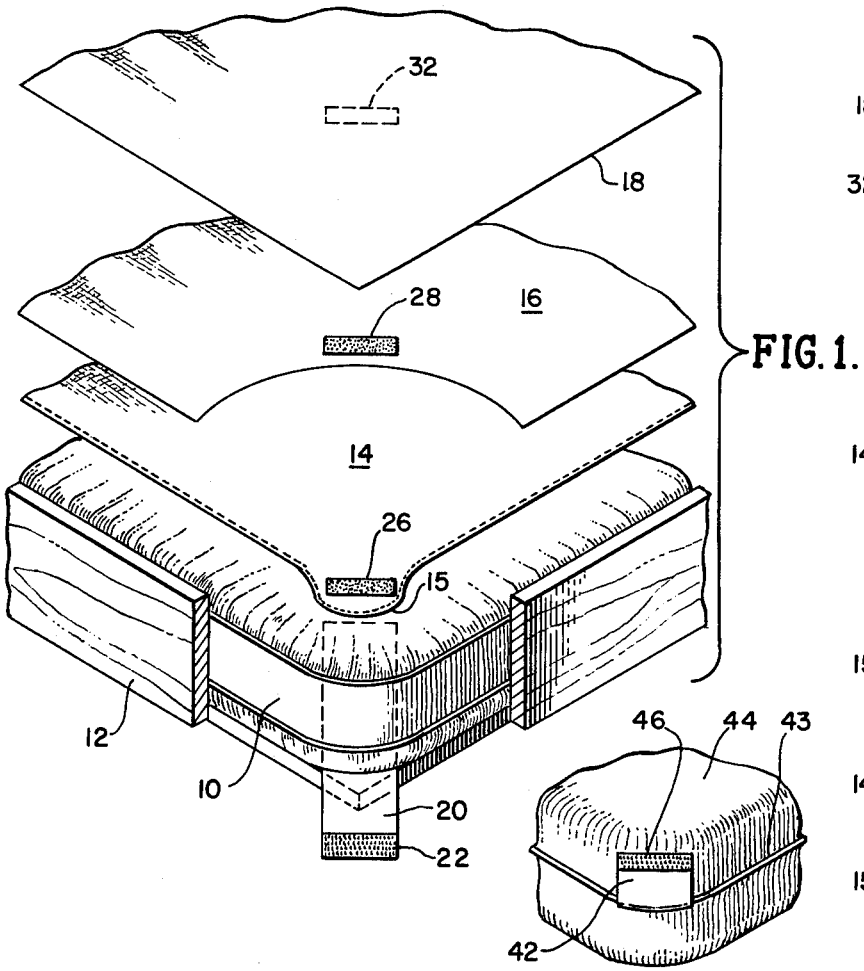
FIG. 1.
FIG. 10.
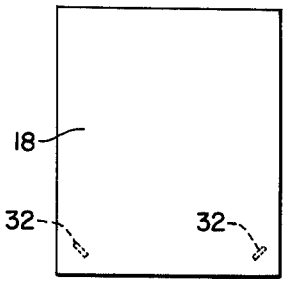
FIG. 2.
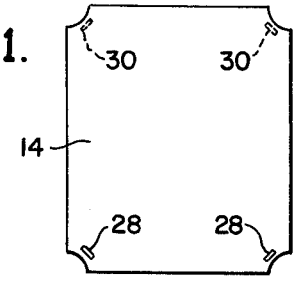
FIG. 3.
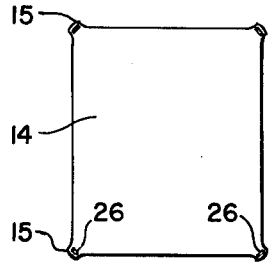
FIG. 4.
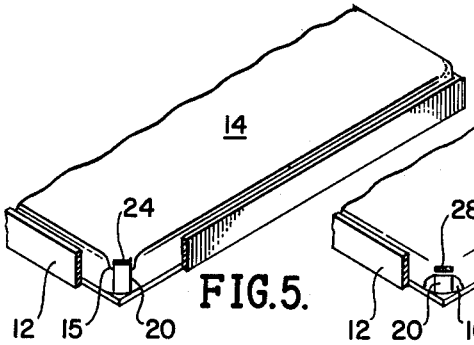
FIG. 5.
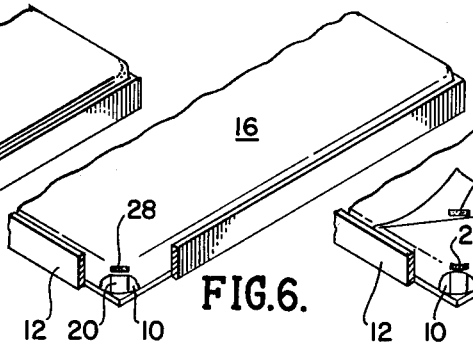
FIG. 6.
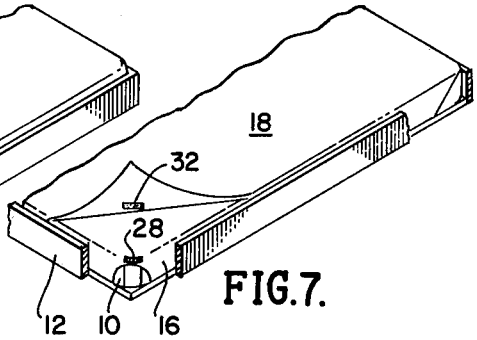
FIG. 7.
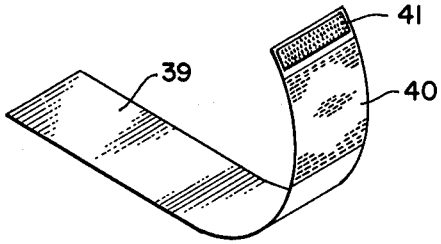
FIG. 8.
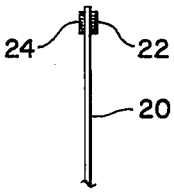
FIG. 9.

BEDDING ATTACHMENT SYSTEM

This invention relates to an improved bedding attachment system that is particularly useful in connection with waterbeds.

During the past few years, waterbeds have become increasingly popular. While there are many attractive features of such beds, one drawback has been that it is more difficult to make a waterbed then it is with a conventional mattress. A primary reason for this is that the mattress is confined within a frame around its edge and the heavy mattress presses against the frame. Consequently, it is difficult to tuck bedding into this area and harder yet to lift the mattress to put a sheet beneath the mattress. An even greater drawback is that even after the bed is made, it comes loose very readily due to the shifting and rolling of a waterbed mattress. It is very difficult, if not impossible, to confine sheeting beneath the mattress.

Because of the difficulty of making a waterbed and causing it to remain in a neat condition, some people, particularly women, are reluctant to buy waterbeds. This results in many men making beds instead of women which in turn hinders acceptance of waterbeds.

In accordance with the present invention, a system is provided which not only makes it much easier to make a waterbed but more importantly will hold the bedding in position. Basically, this system employs Velcro or similar, effective but readily separable, attachment means extending between the mattress and the various pads, sheets and other bedding which may be employed.

In one form of the invention, particularly for existing waterbed mattresses, the attachment means for the mattress is in the form of an elongated strip of plastic or other material, one end of which is placed beneath the corner of the mattress, to be held in position by the weight of the mattress while the other end extends from beneath the mattress to be located between the edge of the mattress and the surrounding frame. A Velcro section or other similar flexible means is secured to the end of the strap located on the side of the mattress. A mating section of Velcro or other such material on the lower sheet is secured to the strap secured by the mattress.

If a mattress pad is employed, a similar Velco section is provided thereon to also be attached to the Velcro on the strap. An upper sheet is further provided with a section of Velcro to be attached to a mating section formed on the lower sheet. To facilitate making the bed, the lower sheet has a section cut away on each corner.

To provide greater flexibility to the system, the strap secured to the mattress may include a section of stretchy material. This makes it easier to attach the Velcro section to the mattress pad or the lower sheet and also further accommodates movement of the mattress. In an alternative arrangement, the Velcro sections may be attached directly to the edge of the mattress during the fabrication of the mattress. Typically, a seam is formed around the edge of the mattress, and the Velcro section may be secured to this seam as the mattress bag is being formed.

For a further description of the bedding attachment system of the invention, reference is made to the following detailed description and drawings in which:

FIG. 1 is an exploded perspective view illustrating the bedding system of the invention.

FIG. 2 is a small plan view of the top sheet of FIG. 1;

FIG. 3 is a small plan view of the bottom sheet;

FIG. 4 is a small plan view of the mattress pad;

FIG. 5 is a schematic perspective view showing the foot of a bed with the mattress pad attached;

FIG. 6 is a perspective view of the assembly of FIG. 5 with the bottom sheet in position;

FIG. 7 is a perspective view of the assemblies of FIGS. 5 and 6 with the upper sheet in position on one corner and about to be positioned on the opposite corner.

FIG. 8 is a perspective view showing a modified form of an attachment strap;

FIG. 9 is an edge view of the attachment strap of FIG. 1; and

FIG. 10 is a fragmentary, perspective view showing an attachment strap connected directly to the mattress.

In FIG. 1, there is schematically shown a corner of a waterbed mattress 10 filled with liquid and positioned on a support 11 within a side frame 12. A mattress pad 14, a bottom sheet 16 and a top sheet 18 are shown aligned above the mattress. An elongated strap 20 made of plastic, such as polyvinylcloride or other suitable material, is shown with one end captured beneath the mattress by the weight of the mattress. These straps should be sufficiently strong to satisfactorily handle stress forces that may be applied to the bedding. Twenty mil material has been found to be quite satisfactory.

A small section 22 of Velcro or other such hook and loop attaching material is secured to the end of the strap 20. As seen from FIG. 9, a similar Velcro section 24 is attached to the other side of the strip. Preferably, the sections 22 and 24 are in back-to-back relation but this is not critical and if it is more convenient from a manufacturing standpoint, they can be offset with respect to each other.

The mattress pad 14 has an outwardly extending ear or tab 15 on each corner as seen in FIGS. 1 and 4. A section of Velcro 26 extends on the upper side of the ear 15 on the mattress pad on each corner. As seen, the section 26 is diagonally oriented so that it is generally parallel to the Velcro section 22. The section 26 is selected to mate with the section 22.

The bottom sheet 16 has its corners removed as seen from FIG. 1 and FIG. 3 so that there is no excess material when the sides or edges of the bottom sheet are positioned adjacent the edge of the mattress. The edge of the removed corner is about equal to the thickness of the mattress. A section 28 of fastening material is attached to the top side of the bottom sheet, centrally located adjacent the edge of the corner portion. As may be seen from the drawings, the section 28 extends diagonally with respect to the sides of the sheet, parallel to the Velcro sections on the strap 20 and the pad 14. A similar section of Velcro material is attached to the lower side of the bottom sheet, preferably in back-to-back alignment with the section 28, although as with the Velcro sections on the strap 20, the sections on opposite sides of the bottom sheet need not be complete back-to-back alignment. The Velcro sections 28 are only located on the top side of the two corners of the lower sheet at the foot of the bed, as may be seen in FIG. 3. However, the sections 30, FIG. 3, on the lower side of the bottom sheet are provided on each corner of the sheet since the lower side of each sheet is to be attached to a Velcro section on the strap 20.

The top sheet 18 is also provided with a section 32 of Velcro material spaced inwardly from the corner of the sheet at the two corners on the foot of the bed, as seen in FIG. 2. The sections 32 are aligned and adapted to mate with the sections 28 on the bottom sheet.

In using the bedding system, it is first necessary to install a strap 20 under each corner of the mattress in the position shown in FIG. 1. Note that the strap 20 approximately bisects the angle formed by the mattress sides. The strap 20 is extended far enough beneath the mattress to make sure that the weight of the mattress will hold the strap in position. Sufficient strap is provided so that this will be accomplished if the Velco section 22 on the strap is located about half way up the side of the mattress between the mattress and the adjacent frame 12. The strap 20 is installed beneath the mattress by grasping the corner of the mattress and pulling it back far enough to position the strap. While this operation requires some strength and is similar to that required to make a waterbed mattress without the benefit of the attachment system described herein, it is only necessary to position the four straps one time.

Next, the mattress pad is positioned on the mattress with its corners extending slightly over the sides of the mattress and the Velcro sections 26 on the pad are attached to the sections 22 on the straps 20 as shown in FIG. 5. With this operation complete, the straps are securely anchored to move with the mattress.

Next, the bottom sheet 16 is placed on the mattress pad with the edges extending between the mattress and the surrounding frame 12. The Velcro sections 30 on the bottom side of the bottom sheet are attached to the Velcro sections 24 which are positioned on the outer side of the straps, as the straps are oriented when in operation on the mattress. That is, the sections 24 face towards the side frame 12 and the Velcro sections 30 on the bottom sheet face toward the Velcro sections 24 on the strap. Note from FIG. 6 that with the corners cut out of the bottom sheet 16, the straps 20 are still exposed and readily accessible.

Once the bottom sheet is attached to the straps 20 on each of the corners of the mattress, the top sheet is positioned in place and its Velcro sections 32 are secured to the sections 28 on the foot end of the bottom sheet. These sections are shown about to be mated on the left hand corner of the mattress as shown in FIG. 7. On the right hand corner, the mattress is shown with the upper sheet positioned, and it can be seen that the Velcro strips are completely hidden.

It should be noted that the sheets can be used without a mattress pad with the attachment means being just as described above. Alternatively, without the pad, the sections 22 on the straps 20 can be attached to the sections 30 on the lower sheet (by inverting the lower sheet) and the upper sheet section 32 be connected directly to the strap sections 24.

The main advantages of the bedding attachment system described are that it is relatively easy to make the bed in comparison with the effort required in making a waterbed in the same manner one might make a regular bed; and once the components are attached as described above, they will remain so until the bedding is to be changed. As is well known, Velcro hook and loop fasteners can withstand considerable force in a direction parallel to the material, but they are relatively easy to separate if one section is lifted or peeled from the other. When the bedding is changed, the strap 20, of course, remains in position. The main reason that the bedding stays attached is that the bedding moves with the waterbed mattress. As is well known, a waterbed mattress moves considerably and it is this action that causes bedding positioned in the conventional manner to become loosened.

Velcro is a well-known tradename for separable fasteners having one section formed of small loops and the mating section formed of small hooks. Similar fasteners made by other companies can be used. Also, a wide variety of different attachment means could be used. There are however, several advantages with Velcro type fastners; such as, the beddding can be laundered in the usual fashion and undesirable noise of metal fasteners in an electric dryer is avoided.

As a further variation of the invention, a strap 39 similar to the strap 20 can be made of elastic material or can be provided with an elastic section 40 connecting a Velcro section 41 to the remainder of the strap, as shown in FIG. 8. The elastic has two primary benefits. One, the shifting forces of a waterbed mattress are accommodated more easily with elastic. Secondly, the elastic permits the Velcro end of the strap to be pulled up to the top level of the mattress so that attachment to the mattress pad Velcro section or with the Velcro section on the bottom side of the bottom sheet is more easily made.

As a further variation of the invention, refer to FIG. 10 wherein a shortened strap 42 showing a Velcro section 46 is shown connected directly to a side seam 43 of a waterbed mattress 44. This eliminates the operation of having to insert longer straps 20 of the type shown in FIG. 1 beneath the mattress. On the other hand, the advantage of the separate strap approach is of course, that it can be utilized with existing mattresses.

What is claimed is:

1. A bedding attachment system for a waterbed comprising:

a mattress substantially filled with liquid;

a frame having a bottom wall and side walls supporting and surrounding said mattress;

a separate bedding attachment strap for each corner of the mattress, each strap having one end portion captured between the bottom wall of the frame and the mattress by the weight of the mattress, each of the strap end portions beneath the mattress extending diagonally approximately toward the opposite corner of the mattress, the length of the strap portion beneath the mattress being long enough such that the weight of the mattress will retain the strap in position and yet short enough that one person can position the strap by grasping the corner of the mattress and pulling it back from the frame, the other end of said strap extending upwardly between the mattress edge and the surrounding frame; and bedding attachment means formed on said strap other end for releasable attachment to bedding to be placed on the mattress.

2. The system of claim 1 wherein the attachment means formed on said strap are on each side of the strap whereby the lower side may be attached to a mating attachment surface connected to a first layer of bedding and the upper side may be attached to a mating surface connected to the lower side of a second layer of bedding.

3. The system of claim 1 including a mattress pad positioned on said mattress and having attachment means formed on each corner of the pad connected to said strap attachment means on each side of the strap facing said mattress, and a sheet positioned over said mattress pad, having attachment means on each corner which mates with said strap attachment means on the side of said strap facing away from said mattress.

* * * * *